US009527311B2

(12) United States Patent
Hamazaki et al.

(10) Patent No.: US 9,527,311 B2
(45) Date of Patent: Dec. 27, 2016

(54) DRYING DEVICE AND IMAGE FORMING APPARATUS

(71) Applicant: FUJI XEROX CO., LTD., Tokyo (JP)

(72) Inventors: Toshinobu Hamazaki, Kanagawa (JP); Motoharu Nakao, Kanagawa (JP); Satoshi Hasebe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/583,846

(22) Filed: Dec. 29, 2014

(65) Prior Publication Data

US 2015/0251451 A1 Sep. 10, 2015

(30) Foreign Application Priority Data

Mar. 5, 2014 (JP) ..... 2014-043242

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; G01N 25/56
USPC ..... 347/101, 102, 104
See application file for complete search history.

(56) References Cited

U.S. PATENT DOCUMENTS

2014/0204158 A1* 7/2014 Emamjomeh ..... B41J 11/0015 347/102

FOREIGN PATENT DOCUMENTS

| | | |
|---|---|---|
| JP | 2001-301131 | 10/2001 |
| JP | 2006-212929 | 8/2006 |
| JP | 2008-119980 | 5/2008 |
| JP | 2009-126160 | 6/2009 |
| JP | 2011-056673 | 3/2011 |
| JP | 2011-121193 | 6/2011 |

OTHER PUBLICATIONS

Abstract and machine translation of JP 2001-301131.
Abstract and machine translation of JP 2006-212929.
Abstract and machine translation of JP 2008-119980.
Abstract and machine translation of JP 2009-126160.
Abstract and machine translation of JP 2011-056673.
Abstract and machine translation of JP 2011-121193.

* cited by examiner

*Primary Examiner* — Jannelle M Lebron
(74) *Attorney, Agent, or Firm* — Fildes & Outland, P.C.

(57) ABSTRACT

There is provided a drying device. A drying unit is configured to dry a recording medium having an image formed thereon by an image forming unit. A detection unit is configured to detect a moisture content ratio of a print part having predetermined density and size and formed on the recording medium and a moisture content ratio of a blank part, which is a region of the recording medium on which an image is not formed, before the recording medium having the image formed thereon is conveyed to the drying unit by a conveyance unit. A control unit is configured to control at least one of a drying strength of the drying unit and a conveying speed of the conveyance unit on the basis of the moisture content ratio of the print part and the moisture content ratio of the blank part.

10 Claims, 14 Drawing Sheets

FIG. 5A

| | | SIZE OF TEST PRINT PART | | |
|---|---|---|---|---|
| | | 40mm | 80mm | 120mm |
| DROPLET EJECTION RATIO OF TEST PRINT PART | 50% | PRINTING CONDITION 1 | PRINTING CONDITION 2 | PRINTING CONDITION 3 |
| | 100% | PRINTING CONDITION 4 | PRINTING CONDITION 5 | PRINTING CONDITION 6 |
| | 200% | PRINTING CONDITION 7 | PRINTING CONDITION 8 | PRINTING CONDITION 9 |

FIG. 5B

| SELECTION CONDITION | PRINT IMAGE INFORMATION | | PRINTING CONDITION OF TEST PRINT PART |
|---|---|---|---|
| | MAXIMUM DROPLET EJECTION RATIO X[%] | SIZE OF MAXIMUM EXTRACTION REGION Y[MM] | |
| 1 | $100<X\leqq200$ | $80<Y$ | PRINTING CONDITION 9 |
| 2 | $100<X\leqq200$ | $40<Y\leqq80$ | PRINTING CONDITION 8 |
| 3 | $100<X\leqq200$ | $20<Y\leqq40$ | PRINTING CONDITION 7 |
| 4 | $50<X\leqq100$ | $80<Y$ | PRINTING CONDITION 6 |
| 5 | $50<X\leqq100$ | $40<Y\leqq80$ | PRINTING CONDITION 5 |
| 6 | $50<X\leqq100$ | $20<Y\leqq40$ | PRINTING CONDITION 4 |
| 7 | $X\leqq50$ | $80<Y$ | PRINTING CONDITION 3 |
| 8 | $X\leqq50$ | $40<Y\leqq80$ | PRINTING CONDITION 2 |
| 9 | $X\leqq50$ | $Y\leqq40$ | PRINTING CONDITION 1 |

| CHARAC-TERISTIC | MOISTURE CONTENT RATIO DIFFERENCE $\alpha d$ |
|---|---|
| W1 | 3.0 |
| W2 | 2.3 |
| W3 | 1.4 |

| CHARAC-TERISTIC | HEATER OUTPUT(%) | SHEET SPEED (m/MINUTE) |
|---|---|---|
| C1 | 100 | 100 |
| C2 | 80 | 80 |
| C3 | 50 | 50 |

| MOISTURE CONTENT RATIO DIFFERENCE αd | HEATER OUTPUT (%) | SHEET SPEED (m/MINUTE) |
|---|---|---|
| LESS THAN 2.2% | 100 | 100 |
| 2.2% OR GREATER AND LESS THAN 2.7% | 80 | 80 |
| 2.7% OR GREATER | 50 | 50 |

DRYING DEVICE AND IMAGE FORMING APPARATUS

CROSS-REFERENCE TO RELATED APPLICATIONS

This application is based on and claims priority under 35 U.S.C. §119 from Japanese Patent Application No. 2014-043242 filed on Mar. 5, 2014.

TECHNICAL FIELD

The present invention relates to a drying device and an image forming apparatus.

SUMMARY

According to a first aspect of the exemplary embodiments of the present invention, there is provided a drying device comprising: a drying unit configured to dry a recording medium having an image formed thereon by an image forming unit; a detection unit configured to detect a moisture content ratio of a print part having predetermined density and size and formed on the recording medium and a moisture content ratio of a blank part, which is a region of the recording medium on which an image is not formed, before the recording medium having the image formed thereon is conveyed to the drying unit by a conveyance unit; and a control unit configured to control at least one of a drying strength of the drying unit and a conveying speed of the conveyance unit on the basis Of the moisture content ratio of the print part and the moisture content ratio of the blank part.

BRIEF DESCRIPTION OF THE DRAWINGS

Exemplary embodiments of the present invention will be described in detailed based on the following figures, wherein:

FIGS. 5A and 5B show a test print part printing condition LUT according to the first illustrative embodiment;

DETAILED DESCRIPTION

Hereinafter, illustrative embodiments of the present invention will be described in detail with reference to the drawings. Meanwhile, in the illustrative embodiments, the present invention is applied to an image forming apparatus of an inkjet type.

[First Illustrative Embodiment]

An image forming apparatus 10 of this illustrative embodiment is described with reference to FIGS. 1 to 9.

Figure 1:
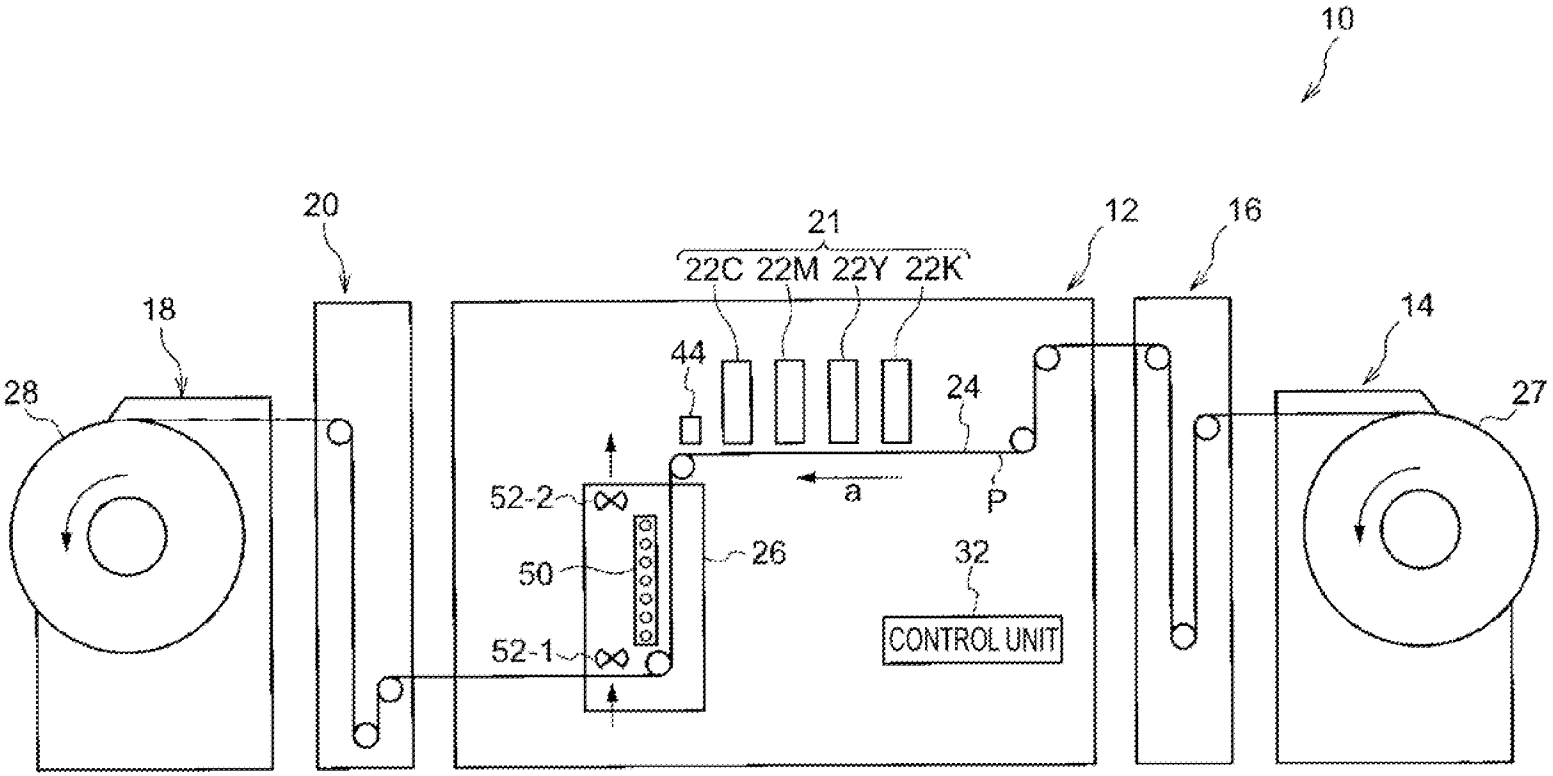
FIG. 1 is a schematic configuration view illustrating an example of a configuration of an image forming apparatus according to a first illustrative embodiment.

As shown in FIG. 1, the image forming apparatus 10 has an image forming unit 12 configured to form an image on a continuous business form sheet P, which is an example of a recording medium, a pre-processing unit 14 configured to accommodate therein the continuous business form sheet P to be fed to the image forming unit 12, and a buffer unit 16 arranged between the image forming unit 12 and the pre-processing unit 14 and configured to regulate a conveying amount and the like of the continuous business form sheet P fed from the pre-processing unit 14 towards the image forming unit 12.

Also, the image forming apparatus 10 has a post-processing unit 18 configured to accommodate therein the continuous business form sheet P discharged from the image forming unit 12 and a buffer unit 20 arranged between the image forming unit 2 and the post-processing unit 18 and configured to regulate a conveying amount and the like of the continuous business form sheet P discharged from the image forming unit 12 towards the post-processing unit 18.

The image forming unit 12 has a roll member (a reference numeral thereof is omitted) configured to guide the continuous business form sheet P along a conveyance path 24 of the continuous business form sheet P and a droplet discharge device 21 configured to discharge droplets onto the continuous business form sheet P being conveyed along the conveyance path 24 of the continuous business form sheet P and to form an image thereon.

The droplet discharge device 21 has a droplet discharge head 22K configured to discharge ink drops (an example of the droplets) onto the continuous business form sheet P and to form a K (black) image thereon, a droplet discharge head 22Y configured to discharge ink drops onto the continuous business form sheet P and to form a Y (yellow) image thereon, a droplet discharge head 22M configured to discharge ink drops onto the continuous business form sheet P and to form an M (magenta) image thereon, and a droplet discharge head 22C configured to discharge ink drops onto the continuous business form sheet P and to form a C (cyan) image thereon. The droplet discharge head 22K, the droplet discharge bead 22Y, the droplet discharge bead 22M and the droplet discharge head 22C are aligned to face the continuous business form sheet P in corresponding order from an upstream side towards a downstream side along a conveying direction (denoted with an arrow a in FIG. 1. Hereinafter, it may also be referred to as 'sheet conveying direction') of the continuous business form sheet P.

Meanwhile, in this illustrative embodiment, the aligning order of the droplet discharge head 22K, the droplet discharge head 22Y, the droplet discharge head 22M and the droplet discharge head 22C is jus exemplary and is not limited to the order shown in FIG. 1. Also, in below descriptions, when the reference numerals K, Y, M, C are not discriminated, the denoted reference numerals K, Y, M, C are omitted.

Further, a drying device 26 used to dry the image formed on the continuous business form sheet P is disposed at a downstream side of the droplet discharge device 21 with respect to the sheet conveying direction. The drying device 26 includes a heater 50 configured to supply heat for drying the image formed on the continuous business form sheet P and fans 52-1, 52-2 (hereinafter, which may also be collectively referred to as 'fan 52') configured to cool the heater 50 and to discharge the high humidity air in the drying device 26.

The fan 52 is configured to suck the air from the fan 52-1 and to blow the air towards the heater 50 in an arrow direction shown in FIG. 1, and is also configured to discharge the air stream having absorbed the heat and the high humidity air in the drying device 26 by the fan 52-2. As the heater 50, an infrared heater, a halogen heater and the like may be used. However, the present invention is not limited. In this illustrative embodiment, the infrared heater is used.

Further, the image forming unit 12 is provided with a control unit 32 configured to control the respective units of the image forming apparatus 10.

In the meantime, the pre-processing unit 14 has a feeder roll 27 on which the continuous business form sheet P to be fed to the image forming unit 12 is wound. The feeder roll 27 is rotatably supported to a frame member (not shown).

In contrast, the post-processing unit 18 has a winding roil 28 configured to wind the continuous business form sheet P having the image formed thereon. When the winding roll 28 is rotated by a rotating force from a motor (not shown), the continuous business form sheet P is conveyed along the conveyance path 24. A motor control unit 42 (refer to FIG. 2) provided for the control unit 32 is configured to control the motor for transmitting the rotating force to the winding roll 28, thereby changing the conveying speed of the continuous business form sheet P. Thereby, a user can change the conveying speed of the continuous business form sheet P for each job of the image formation, for example. Here, in this illustrative embodiment, the 'job' means a series of operations after the image formation starts in the image forming apparatus 10 until the image formation stops.

By the above configuration, when the winding roll 28 is rotated, a tensional force in the sheet conveying direction is applied to the continuous business form sheet P and the continuous business form sheet P fed from the feeder roll 27 is conveyed along the conveyance path 24. The droplet discharge heads 22 discharge the ink drops of each color onto the continuous business form sheet P being conveyed, thereby forming an image on the continuous business form sheet P.

The continuous business form sheet P having the image formed thereon passes through the drying device 26, so that the image formed on the continuous business form sheet P is dried by the heater 50. Then, the continuous business form sheet P is wound by the winding roll 28.

In this illustrative embodiment, the image forming apparatus 10 further has a moisture content ratio meter 44. The moisture content ratio meter 44 will be described in detail later.

Subsequently, a configuration of main units of an electric system of the image forming apparatus 10 is described with reference to FIG. 2.

Figure 2:
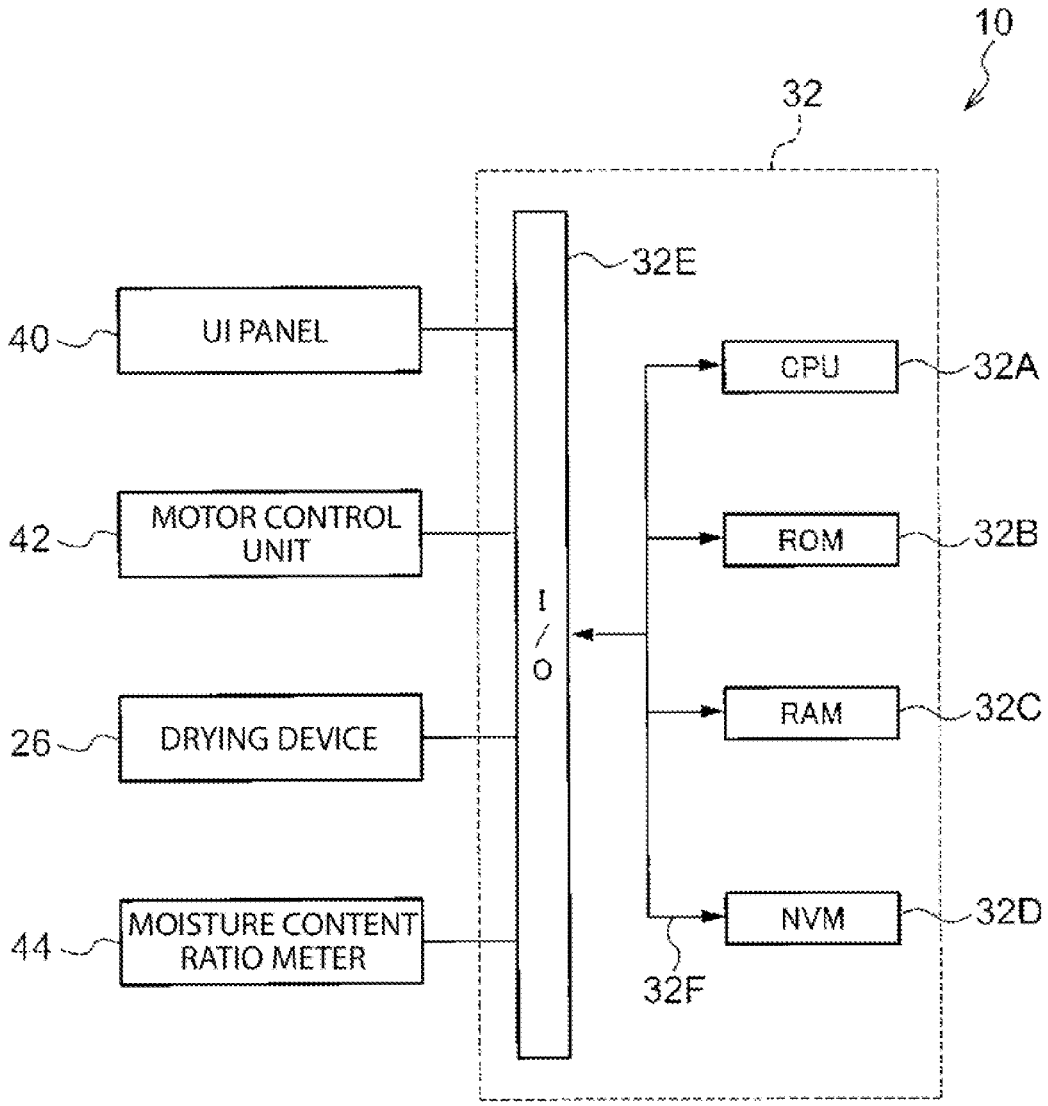
FIG. 2 is a block diagram showing an example of a configuration of main units of an electric system of the image forming apparatus according to the first illustrative embodiment.

As shown in FIG. 2, the control unit 32 of the image forming apparatus 10 has a CPU (Central Processing Unit) 32A, a ROM (Read Only Memory) 328, a RAM (Random Access Memory) 32C, an NVM (Non Volatile Memory) 32D and an input/output port (I/O) 32E, which are respectively connected to each other through a bus 32F such as an address bus, a data bus and a control bus.

The ROM 32B is configured to store therein a variety of programs such as a program for controlling the entire image forming apparatus 10, a drying control processing program (which will be described later) and the like. The CPU 32A is configured to read out the programs from the ROM 32B and to develop and execute the same into the RAM 32C, so that a variety of controls are performed.

The NVM 32D is a non-volatile storage medium configured to store therein a variety of information that should be kept even when a power supply switch of the apparatus becomes off.

The I/O 32E is connected with a user interface (UI) panel 40, the motor control unit 42, the drying device 26 and the moisture content ratio meter 44. The UI panel 40 is configured by a touch panel display having a transmission touch panel superimposed on a display, for example. A variety of information is displayed on a display surface of the display, and the user touches the touch panel, so that the information and an instruction can be received. Meanwhile, in this illustrative embodiment, an example where the UI panel 40 is applied is described. However, the present invention is not limited thereto. For example, a display unit such as a liquid crystal monitor and an operation unit having ten keys, an operation button and the like may be separately provided.

As described above, the motor control unit 42 is configured to control the motor for transmitting the rotating force to the winding roll 28 via the CPU 32A, thereby changing the conveying speed of the continuous business form sheet P.

In the drying device 26, a heater output (heater light amount) of the heater 50, a wind speed of the fan 52 and the like are set under control of the CPU 32A.

The moisture content ratio meter 44 is configured to measure a moisture content ratio of a test print part TP1 (refer to FIG. 3) formed on the continuous business form sheet P in drying control processing of the illustrative embodiment, which will be described later. The moisture content ratio means a ratio (weight percentage) of a weight of moisture contained in the continuous business form sheet P having the image formed thereon to a weight of the continuous business form sheet P having the image formed thereon. The moisture content ratio may also be indicated by a volume percentage. Also, the moisture content ratio meter 44 may be a contact type or non-contact type and is not particularly limited. In the image forming apparatus 10 of this illustrative embodiment, a reflection type moisture content ratio meter configured to illuminate infrared rays to a measuring part and to measure a moisture content ratio from the reflectivity thereof is adopted.

In an image forming apparatus for which a high-speed image formation (hereinafter, also referred to as 'printing') is required, a drying means for drying a printing surface may be provided at a downstream side of the image forming unit. Particularly, the image forming apparatus of an inkjet type using a continuous business form sheet as the recording medium, like the image forming apparatus 10 of this illustrative embodiment, is provided with the drying means in many cases because it is necessary to dry the priming surface in a short time.

Here, when the drying energy of the drying means is insufficient, a transfer (offset) of an image may occur at the sheet winding part (for example, the winding roll 28 shown in FIG. 1) or a roller for sheet conveyance (for example, each roll member shown in FIG. 1) may be stained.

On the other hand, when the drying energy of the drying means is excessive, sheet deformation (wrinkle and the like) and the like may occur. The shape, degree and the like of the sheet deformation are changed depending on a difference (hereinafter, also referred to as 'moisture content ratio difference') of moisture content ratios between a print part and a non-print part (hereinafter, also referred to as 'blank part') of the continuous business form sheet, a type of droplets (in below descriptions, an example where inks are used as the droplets is described) used for the droplet discharge device, a type of the continuous business form sheet, a thickness of the continuous business form sheet, a size of a printing region of the continuous business form sheet, and the like. Among them, the moisture content ratio difference is changed depending on a moisture content ratio before the printing (which depends on environmental conditions of the image forming apparatus and a pre-process of the printing), a droplet ejection amount of ink, environmental conditions (mainly, temperature and humidity conditions), and the like. Therefore, from a standpoint of suppressing the stain or sheet deformation, it is preferably to control the drying energy of the drying means, considering the moisture content ratio difference.

Therefore, the image forming apparatus 10 of this illustrative embodiment is configured to measure moisture content ratios of a test print part and a blank part around the test print part and to calculate the moisture content ratio difference therebetween, before the printed continuous business form sheet P enters the drying device 26. That is, a printed state of the continuous business form sheet P is detected before the continuous business form sheet P enters the drying device 26. Then, at least one of the heater output and the sheet speed, which are the dying conditions, is determined depending on the calculated moisture content ratio difference.

In the below, a method of measuring the moisture content ratio difference by using the test print part according to this illustrative embodiment is described with reference to FIG. 3.

Figure 3:
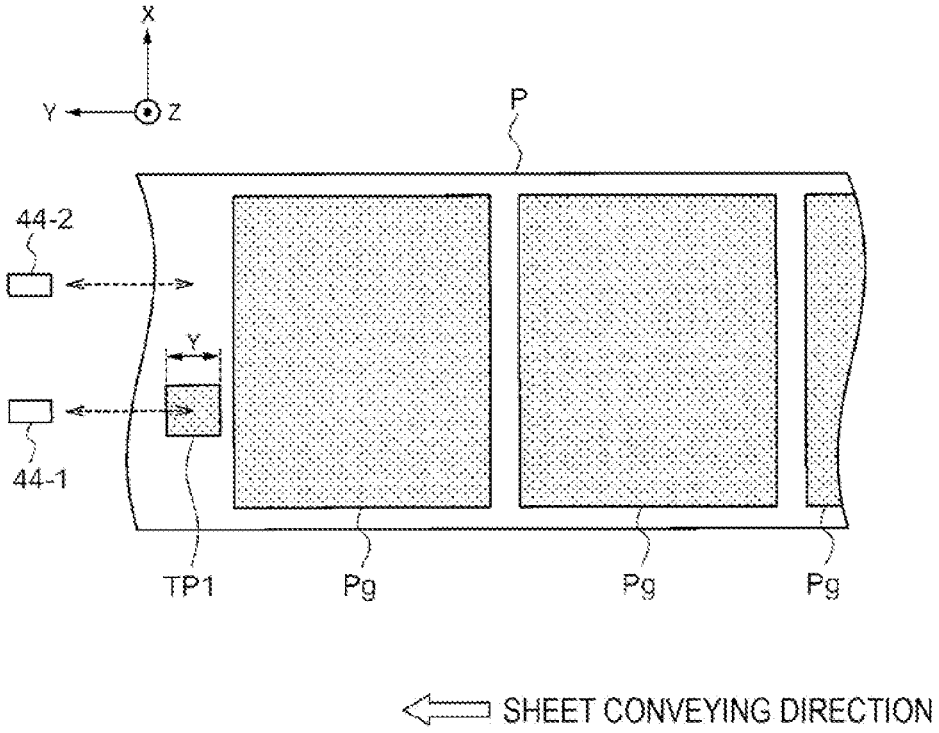
FIG. 3 is a plan view illustrating an arrangement relation between a printed state on a continuous business form sheet and a moisture content ratio meter according to the first illustrative embodiment.

As shown in FIG. 3, the continuous business form sheet P is formed with the test print part TP1 and image regions Pg (in FIG. 3, two image regions Pg and a part of a third image region Pg are shown) in corresponding order along the sheet conveying direction.

The image region Pg indicates an image printed on the basis of the image information in the image forming apparatus 10, i.e., an image printed in the original job.

In this illustrative embodiment, the test print part TP1 is disposed at a position of the head of the image region Pg and is formed as a square print part having one side of Y mm (so-called, a solid pattern) printed with a predetermined droplet ejection ratio. The droplet ejection rate means a ratio of a number of ejected droplets per a unit area (corresponding to a pixel number in the image information of an image to be printed) to a number of ejectable droplets. When the ink is ejected with a total number of ejectable droplets in a single color, the droplet ejection ratio is 100%. Also, when inks of two colors are composed to reproduce another color, the droplet ejection ratio is maximum 200%.

As described in detail later, printing conditions (the droplet ejection ratio and a size) of the test print part TP1 are determined by extracting a droplet ejection ratio and a size of a region becoming a high density, on the basis of the image information of the image region Pg. More specifically, a maximum droplet ejection ratio is calculated from the image information of an image to be printed and a size of a maximum region (hereinafter, also referred to as 'maximum extraction region') of regions having a predetermined shape in the region of the maximum droplet ejection ratio is obtained. Meanwhile, in this illustrative embodiment, the predetermined shape is a square shape.

Figure 4:
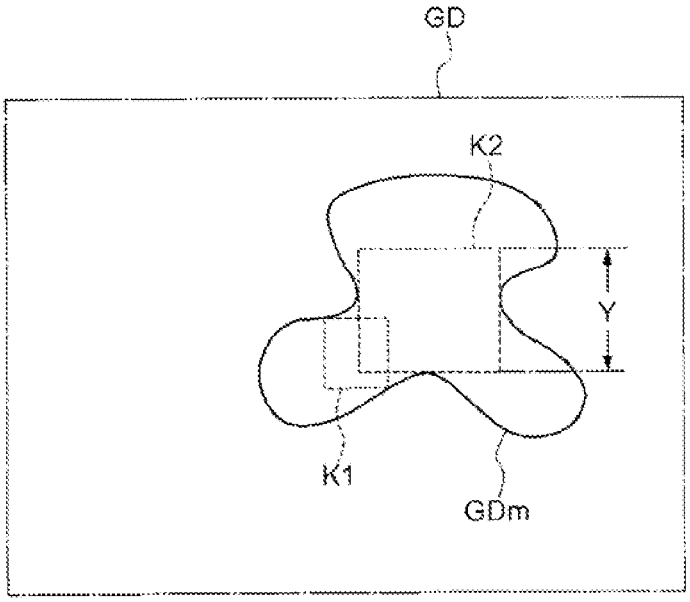
FIG. 4 is a conceptual view illustrating a method of obtaining a maximum extraction region according to the first illustrative embodiment.

A method of obtaining a size of the maximum extraction region is described with reference to FIG. 4. In FIG. 4, a reference numeral 'GD' indicates the image information of an image to be printed, and a reference numeral 'GDm' indicates a region (hereinafter, also referred to as 'maximum droplet ejection ratio region') of the image information having a maximum droplet ejection ratio in the image information GD. When squares inscribed in an outer edge of the maximum droplet ejection ratio region GDm are drawn, a length of one side of a maximum square is a size of the maximum extraction region. In FIG. 4, two squares K1, K2 inscribed in the maximum droplet ejection ratio region GDm are drawn. However, if the square K2 is a square having a maximum size, a length Y of one side of the square K2 is a size of the maximum extraction region. Based on the maximum droplet ejection ratio and the size of the maximum extraction region, printing conditions of the test print part TP1 are determined. Thereby, an appropriate test print part is determined depending on an image to be printed.

Meanwhile, in this illustrative embodiment, the square is adopted as the predetermined shape. However, the present invention is not limited to the square inasmuch as the predetermined shape is an isotropic shape. For example, the other shapes such as a circle and the like may also be adopted. Also, the color used for printing of the test print part TP1 may be a predetermined fixed color and may also be selected from colors of regions becoming a high density of the image regions Pg.

Further, in this illustrative embodiment, an example where the maximum size of the square in the maximum droplet ejection ratio region GDm in the image information GD is obtained is described. However, the present invention is not limited thereto. For example, a maximum size within a range from the maximum droplet ejection ratio to a droplet ejection ratio lower than the maximum droplet ejection ratio by a predetermined droplet ejection ratio may be obtained.

Referring to FIG. 3, two moisture content ratio meters 44-1, 44-2 are shown as the moisture content ratio meter 44. In the image forming apparatus 10 of this illustrative embodiment, a moisture content ratio $\alpha_t$ of the test print part TP1 is measured at the moisture content ratio meter 44-1, and a moisture content ratio $\alpha_h$ of the blank part (a part of the continuous business form sheet P on which the printing is not performed) is measured at the moisture content ratio meter 441-2. Then, a moisture content ratio difference $\alpha_d$ is calculated by a following equation (1).

$$\alpha_d=\alpha_t-\alpha_h(\%) \quad (1)$$

As described later, in the image forming apparatus 10 of this illustrative embodiment, the heater output of the heater 50 of the drying device 20 and the sheet speed are determined on the basis of the moisture content ratio difference $\alpha_d$.

The way of selecting the test print part TP1 is described in more detail with reference to FIGS. 5A and 5B. FIGS. 5A and 5B shows a test print part printing condition LUT (lookup table) for selecting the printing conditions of the test print part TP1.

FIG. 5A shows combinations of the droplet ejection ratio and size of the test print part TP1 beforehand prepared in the image forming apparatus 10 of this illustrative embodiment. As shown in the table, in this illustrative embodiment, nine test print parts of printing conditions 1 to 9 are prepared. In FIG. 5A, the test print part of the printing condition 1 means printing the test print part TP1 of a solid pattern of which the droplet ejection ratio is 50% and a size is 40 mm×40 mm.

Also, FIG. 5B is a table showing a relation between the maximum droplet ejection ratio X (%) and the size of the maximum extraction region of the image information of an image to be printed (an image of a job) and the printing condition (the printing conditions 1 to 9) of the test print part.

In FIG. 5B, for the selection condition 1, i.e., when the maximum droplet ejection ratio X of the image information GD is $100<X\leq200$ (%) and the size Y of the maximum extraction region in the maximum droplet ejection ratio region GDm is $80<Y$ (mm), the printing condition 9 (i.e., the test print part TP1 of which the droplet ejection ratio is 200% and the size is 120 mm is printed) is selected. Also, even though the maximum droplet ejection ratio X is the same, when the size of the maximum extraction region is $40<Y\leq80$ (mm), the printing condition 8 (i.e., the test print part TP1 of which the droplet election ratio is 200% and the size is 80 mm is printed) is selected, as shown in the selection condition 2.

In the image forming apparatus 10 of this illustrative embodiment, the test print part TP1 of the printing condition selected as described above is arranged and printed at the position shown in FIG. 3 and the moisture content ratio difference $\alpha_d$ is calculated by the above-described method.

In the meantime, the printing conditions of the test print part TP1 shown in FIG. 5A and the selection conditions of the printings condition shown in FIG. 5B may be preset by a simulation, a test using an actual equipment, and the like and may be stored in the storage means such as the ROM 32B, the NVM 32D and the like.

Figure 6:
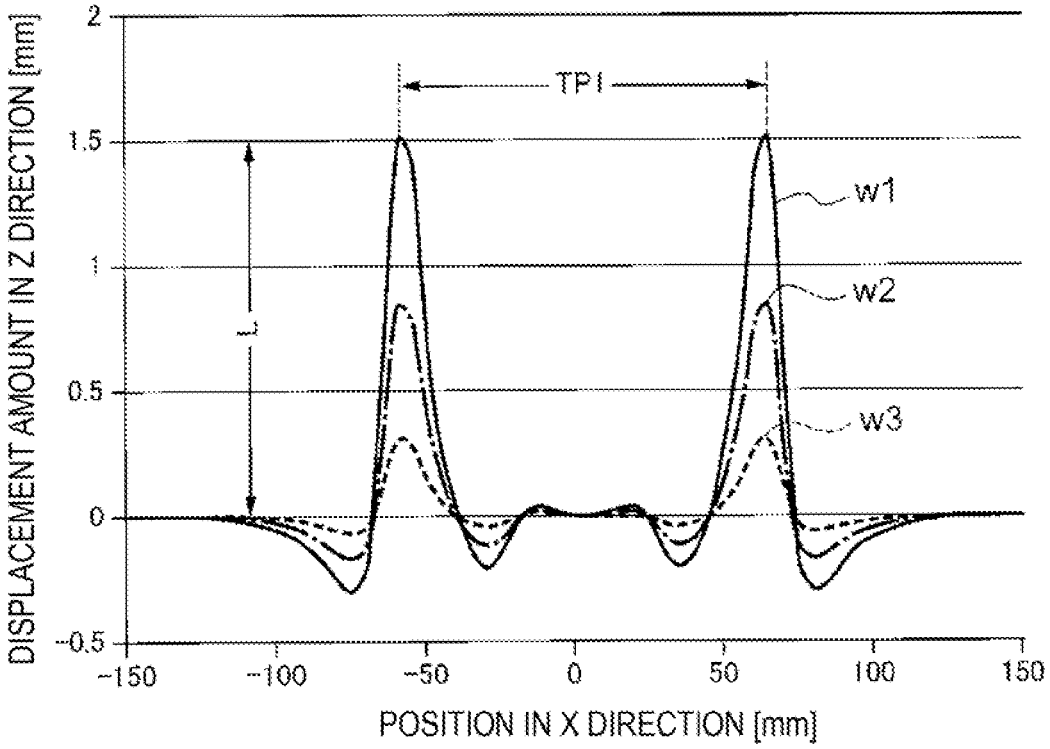
FIG. 6 is a graph showing a relation between a moisture content ratio difference and a distribution of sheet deformation according to the first illustrative embodiment.

Here, a relation between the moisture content ratio difference $\alpha_d$ and the sheet deformation is described in more detail with reference to FIG. 6. FIG. 6 shows as relation between a position in the X direction and a deformation amount in the Z direction, in which the moisture content ratio difference $\alpha_d$ is used as a parameter, when a coordinate system shown in FIG. 3 having a center of the test print part TP1 as an origin is taken with respect to the test print part TP1, i.e., when a right-handed coordinate system of which a Y axis is set as the sheet conveying direction, an X axis is set as a direction intersecting with the sheet conveying direction and a Z axis is set as a direction facing from an inner side of the drawing sheet towards a from side thereof is taken with respect to the test print part TP1. In FIG. 6, to characteristic W1 indicates a relation at the moisture content ratio difference of 3.0%, as characteristic W2 indicates a relation at the moisture content ratio difference of 2.3% and a characteristic W3 indicates a relation at the moisture content ratio difference of 1.4%. In FIG. 6, a range denoted with the reference numeral TP1 indicates a range of the test print part TP1. Also, a displacement amount from the origin to the peak value is defined as 'maximum displacement amount L'. In FIG. 6, although the maximum displacement amount L (about 1.5 mm in the example of FIG. 6) of the characteristic W1 is shown, the characteristics W2, W3 also have the maximum displacement amount L, respectively.

It can be seen from FIG. 6 that the larger the moisture content ratio difference $\alpha_d$, the displacement amount, i.e., the sheet deformation increases. It can also be seen that the sheet deformation occurs mainly at an edge part of the test print part TP1. That is, it is thought that since an elongation of a part having the high moisture content ratio is large when it is dried and an elongation of a part having the low moisture content ratio is small when it is dried, the sheet deformation occurs mainly due to a difference of the elongations. That is, it is thought that the sheet deformation is likely to occur at a boundary between the print part and the blank part. In the image forming apparatus 10 of this illustrative embodiment, the drying is slowly performed when it is expected that the sheet deformation is large.

Figures 7, 8:
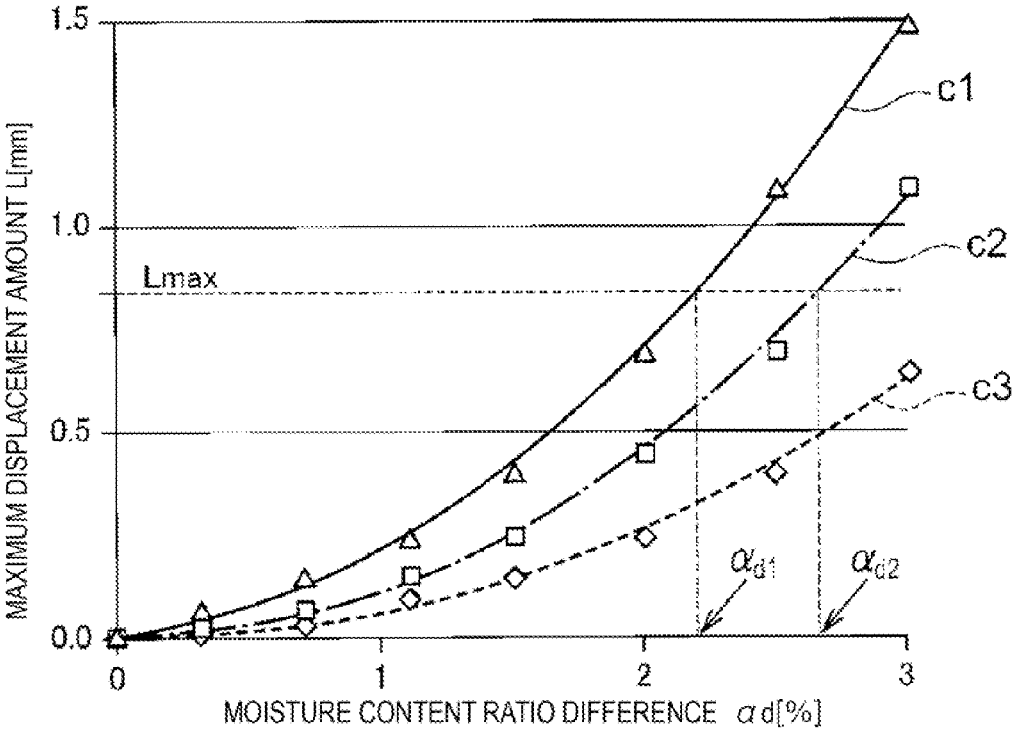
FIG. 7 is a graph for determining a heater output and a sheet speed from a relation between the moisture content ratio difference and a maximum displacement amount according to the first illustrative embodiment.
FIG. 8 shows a drying condition LUT according to the first illustrative embodiment.

Subsequently, a relation between the moisture content ratio difference and the maximum deformation amount L of the continuous business form sheet P where the heater output and the conveying speed (hereinafter, also referred to as 'sheet speed') of the continuous business form sheet P are used as parameters is described. In FIG. 7, a characteristic C1 indicates a relation between the moisture content ratio difference $\alpha_d$ and the maximum deformation amount L when the heater output is 100% and the sheet speed is 100 m/minute, a characteristic C2 indicates a relation between the moisture content ratio difference $\alpha_d$ and the maximum deformation amount L when the heater output is 80% and the sheet speed is 80 m/minute and a characteristic C3 indicates a relation between the moisture content ratio difference $\alpha_d$ and the maximum deformation amount L when the heater output is 50% and the sheet speed is 50 m/minute.

Also, in this illustrative embodiment, an upper limit Lmax of the maximum displacement amount L is 0.8 mm. The upper limit Lmax of the maximum displacement amount L is not limited to 0.8 mm. For example, an appropriate value may also be set, considering a distance between the printing surface of the continuous business form sheet P and a tip of the droplet discharge head 22, and the like when a duplex printing is performed. In the meantime, the heater output of this illustrative embodiment is indicated with a ratio when the maximum output of the heater is set as 100%.

As shown in FIG. 7, the moisture content ratio difference at an intersection point of the line of the maximum displacement amount L (=0.8 mm) and the characteristic C1 is about 2.2% ($\alpha_{d1}$ in FIG. 7) and the moisture content ratio difference at an intersection point oldie line of the maximum displacement amount L (=0.8 mm) and the characteristic C2 is about 2.7% ($\alpha_{d2}$ in FIG. 7). Also, the moisture content ratio difference at an intersection point of the line of the maximum displacement amount L (=0.8 mm) and the characteristic C3 is 3% or greater, which is not shown in FIG. 7.

It can be seen from FIG. 7 that when the upper limit Lmax of the maximum displacement amount L is 0.8 mm, if the moisture content ratio difference $\alpha_d$ is less than 2.2%, the heater output may be set to 100% and the sheet speed may be set to 100 m/minute. On the other hand, it can be seen that when the moisture content ratio difference increases to 2.2% or greater and less than 2.7%, it is necessary to lower the heater output to 80% and the sheet speed to 80 m/minute, i.e., to slowly perform the drying.

FIG. 8 is a drying condition LUT prepared on the basis of the characteristic of FIG. 7 for determining conditions that the heater output and the sheet speed should satisfy, i.e., the drying conditions when the moisture content ratio difference $\alpha_d$ is given. As shown in FIG. 8, the maximum displacement amount L is suppressed to the upper limit Lmax (=0.8 mm) or less, if the heater output is set to 100% and the sheet speed is set to 100 m/minute when the moisture content ratio difference $\alpha_d$ is less than 2.2%, if the heater output is set to 80% and the sheet speed is set to 80 m/minute when the moisture content ratio difference $\alpha_d$ is 2.2% or greater and less than 2.7%, and if the heater output is set to 50% and the sheet speed is set to 50 m/minute when the moisture content ratio difference $\alpha_d$ is equal to or greater than 2.7%. The drying condition LUT may be beforehand stored in the storage means such as the ROM 32B, the NVM 32D and the like.

Figure 9:
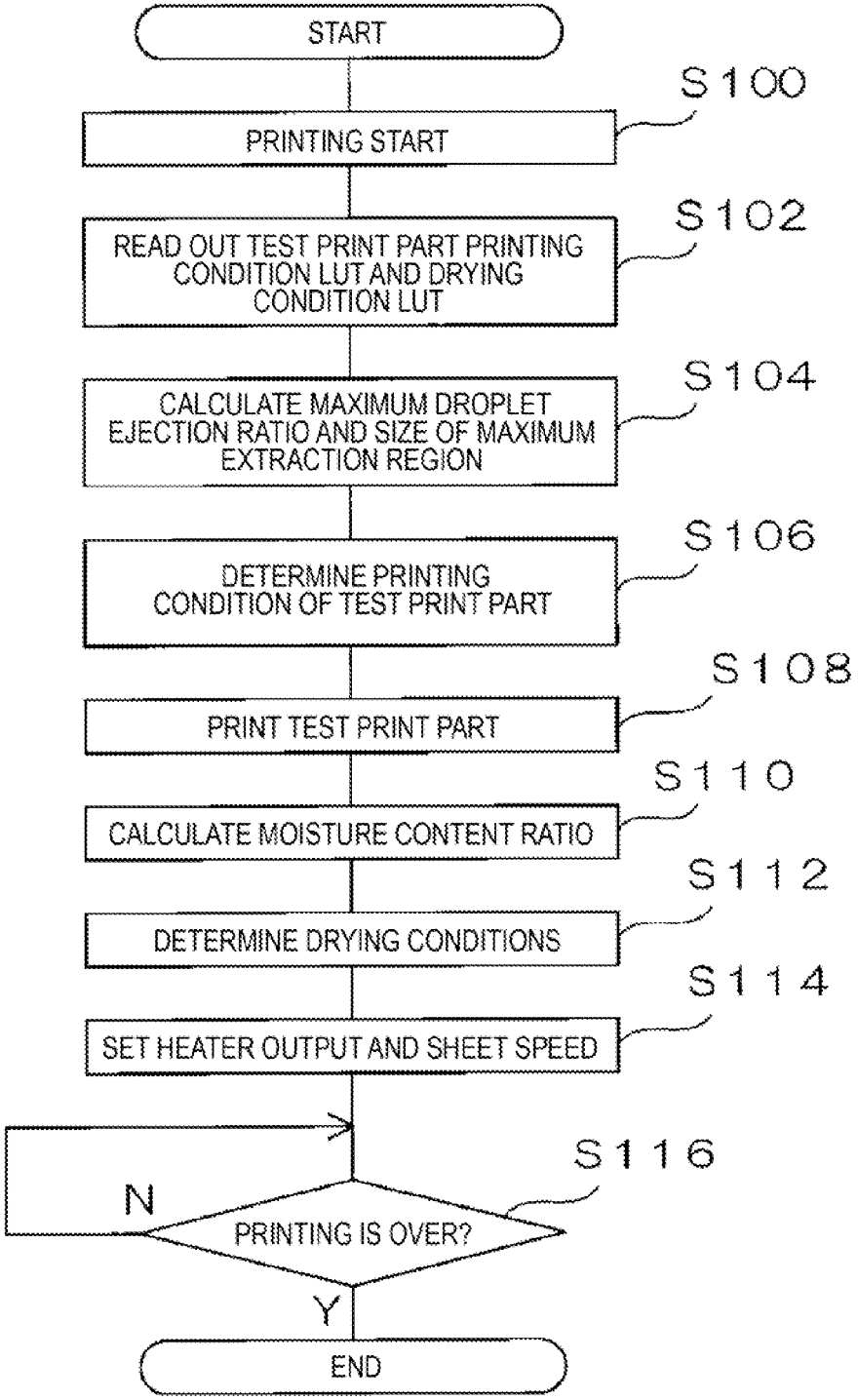
FIG. 9 is a flowchart showing a flow of processing of a drying control processing program according to the first illustrative embodiment.

Subsequently, drying control processing that is executed in the image forming apparatus 10 of this illustrative embodiment is described with reference to FIG. 9. FIG. 9 is a flowchart showing a flow of processing of a drying control processing program that is executed by the CPU 32A of the image forming apparatus 10 of this illustrative embodiment.

After the image information of an image to be printed is supplied from an external apparatus (not shown) and the like to the image forming apparatus 10, when an instruction to start the printing is issued, the CPU 32A reads out a drying control processing program from the storage means such as the ROM 32B and the like, so that the processing shown in FIG. 9 is executed. In the drying control processing of this illustrative embodiment, the test print part TP1 may be arranged at a head of the job and the drying conditions may be controlled for each job. Alternatively, the test print part TP1 may be arranged periodically in the job to periodically control the drying conditions during the job. In FIG. 9, an example where the test print part TP1 is arranged at the head of the job is exemplified.

In this illustrative embodiment, an example where the drying control processing program is beforehand stored in the ROM 32B and the like is described. However, the present invention is not limited thereto. For example, the drying control processing program may be stored in a computer-readable portable storage medium or may be transmitted through a wired or wireless communication means.

Also, in this illustrative embodiment, the drying control processing is implemented by a software configuration using a computer by executing a program. However, the present invention is not limited thereto. For example, the drying control processing may also be implemented by a hardware configuration adopting an ASIC (Application Specific Integrated Circuit) or a combination of the hardware configuration and the software configuration.

As shown in FIG. 9, when the printing starts in step S100, the CPU 32A reads out the test print part printing condition LUT shown in FIGS. 5A and 5B and the drying condition LUT shown in FIG. 8 from the storage means such as the ROM 32B, the NVM 32D and the like, in step S102.

In next step S104, the CPU 32A calculates the maximum droplet ejection ratio and the size of the maximum extraction region on the basis of the image information of an image to be printed by the method described with reference to FIG. 4. The calculated maximum droplet ejection ratio and size of the maximum extraction region may be temporarily stored in the storage means such as the RAM 32C and the like.

In next step S106, the CPU 32A compares the maximum droplet ejection ratio and size of the maximum extraction region calculated in step S104 and the test print part printing condition LUT read out in step S102 and determines the priming condition (the printing conditions 1 to 9 in FIG. 5B) of the test print part TP1.

In next step S108, the CPU 32A controls the droplet discharge head 22 to print the test print part TP1 having the printing condition determined in step S106 before printing an image of the job.

In next step S110, the CPU 32A controls the moisture content ratio meter 44 by the method described with reference to FIG. 3 to measure the moisture content ratios of the print part and the blank part, respectively and then calculates the moisture content ratio difference $\alpha_d$.

In next step S112, the CPU 32A compares the moisture content ratio difference $\alpha_d$ calculated in step S110 and the drying condition LUT read out in step S102 to determine the drying conditions. The determined drying conditions may be temporarily stored in the storage means such as the RAM 32C, the NVM 32D and the like.

In next step S114, the CPU 32A controls the heater 50 to set the heater output and the motor control unit 42 to set the sheet speed on the basis of the drying conditions determined in step S112.

In next step S116, the CPU 32A determines whether the printing is over. When a result of the determination is negative, the CPU 32A continues the printing, and when a result of the determination is positive, the CPU 32A ends the drying condition processing program. The CPU 32A may determine whether the printing is over by determining whether the printing of a number of sheets to be printed set by a user before the printing is completed.

As described in detail above, according to the drying device, the image forming apparatus and the program of this illustrative embodiment, it is possible to suppress the sheet deformation due to the excessive drying energy.

In this illustrative embodiment, both the heater output and the sheet speed are controlled. However, the present invention is not limited. For example, any one of the heater output and the sheet speed may be controlled.

Also, in this illustrative embodiment, one drying condition LUT shown in FIG. 8 is provided. However, the present invention is not limited thereto. For example, a plurality of the drying condition LUTs may be provided depending on a type of the ink (a type such as pigment and dye), a type of the continuous business form sheet P, a thickness of the continuous business form sheet P and the like.

Also, in this illustrative embodiment, the drying energy of the drying device 26 is controlled by the heater output. However, the present invention is not limited thereto. For example, the drying energy may be controlled by an air volume of the fan 52, instead of the heater output or together with the heater output.

Also, in this illustrative embodiment, the present invention is applied to the image forming apparatus configured to print one surface of the continuous business form sheet P. However, the present invention is not limited thereto. For example, the present invention can also be applied to an image forming apparatus configured to print both surfaces. In this case, the test print parts TP1 may be printed on both surfaces of the continuous business form sheet P (the droplet ejection ratios and sizes of the test print parts TP1 may be different between both surfaces) to calculate the moisture content ratio differences $\alpha_d$ and a larger moisture content ratio difference $\alpha_d$ of both surfaces may be adopted to determine the drying conditions.

[Second Illustrative Embodiment]

An image forming apparatus 100 of this illustrative embodiment is described with reference to FIGS. 10 to 16B.

Figure 10:
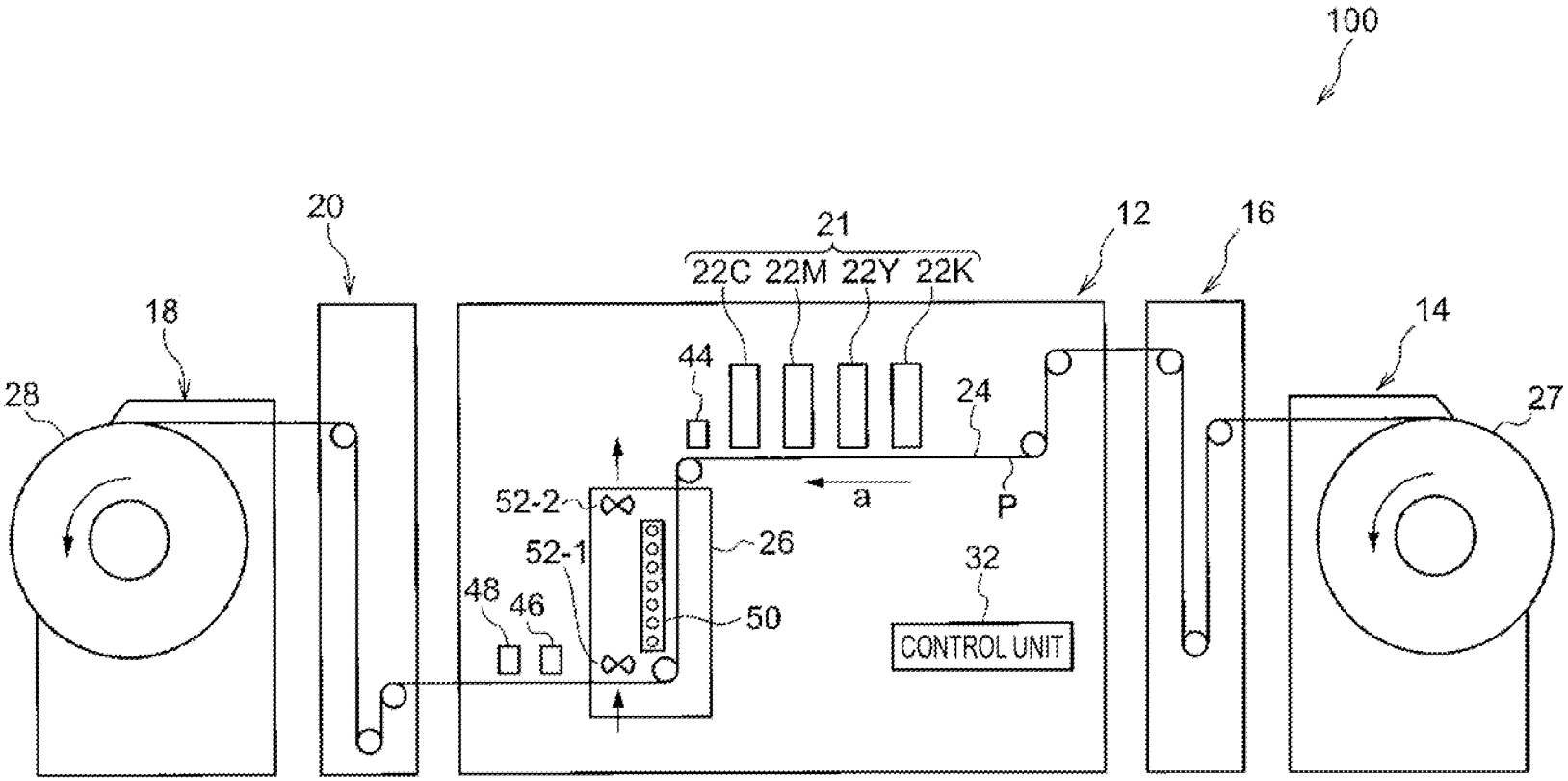
FIG. 10 is a schematic configuration view illustrating an example of a configuration of an image forming apparatus according to a second illustrative embodiment.

FIG. 10 is a schematic configuration view illustrating an example of a configuration of the image forming apparatus 100 of this illustrative embodiment. The image forming apparatus 100 is different from the image forming apparatus 10 shown in FIG. 1, in that the image forming apparatus 100 is further provided with a moisture content ratio meter 46 and as density meter 48 at a downstream side of the drying device 26 with respect to the sheet conveying direction. The other common configurations are denoted with the same reference numerals as FIG. 1 and the descriptions thereof are omitted.

Figure 11:
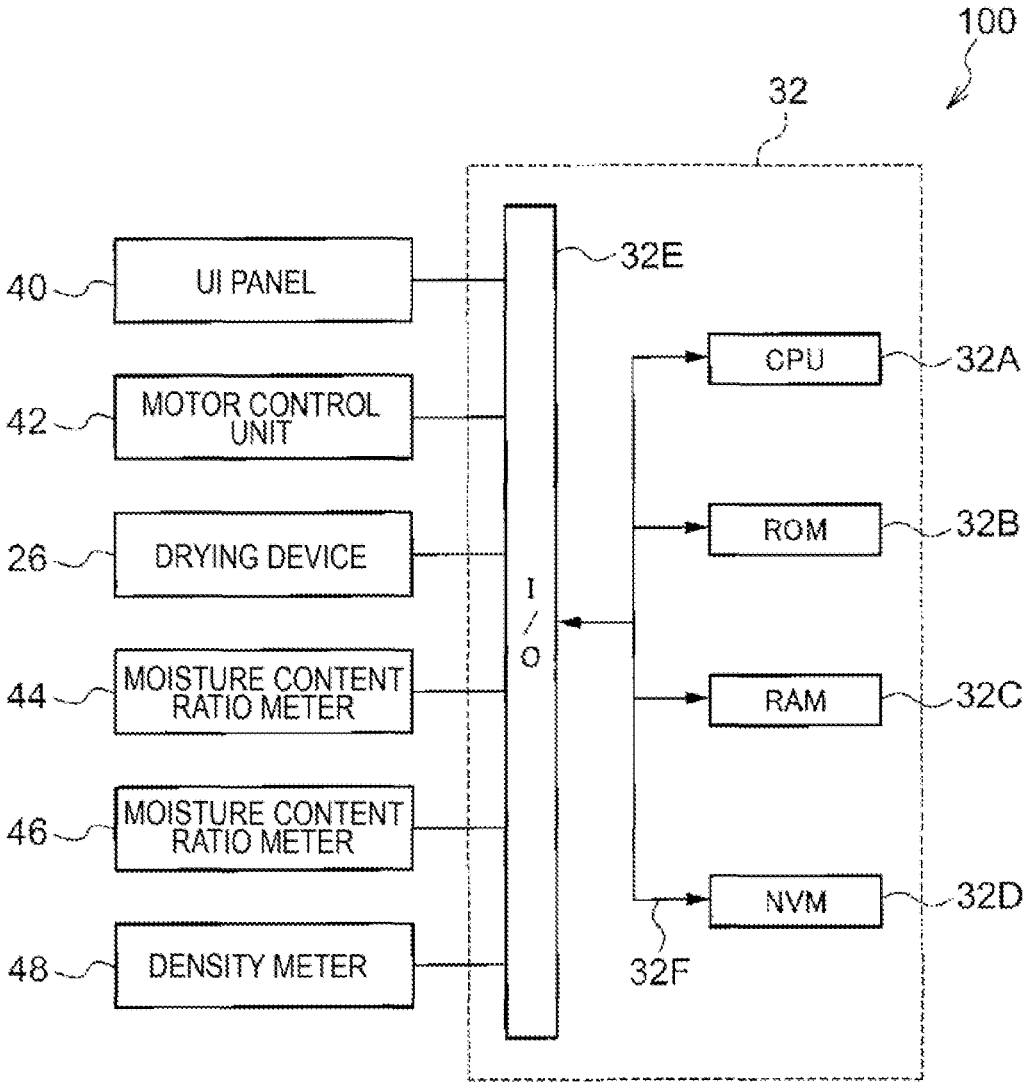
FIG. 11 is a block diagram showing an example of a configuration of main units of an electric system of the image forming apparatus according to the second illustrative embodiment.

FIG. 11 is a block diagram showing a configuration of main units of an electric system of the image forming apparatus 100. As compared to FIG. 1, the I/O 32E of the image forming apparatus 100 is further connected with the moisture content ratio meter 46 and the density meter 48.

As described above, in an image forming apparatus for which the high-speed printing is required, the drying means may be provided at the downstream side of the droplet discharge device with respect to the sheet conveying direction. When the drying in the drying means is insufficient, the ink remains as it is liquid. Therefore, the transfer of the image may occur at the sheet winding part or the roller for sheet conveyance may be stained. In the meantime, if the ink is excessively dried, the ink is not deeply permeated. Therefore, the color material such as pigment of the ink is concentrated on the surface of the recording medium, so that the transfer of the image or the stain occurs. Hence, in order to suppress the transfer of the image and the stain of the roller, it is necessary to perceive a degree of the dryness of the printing surface and an amount of the color material close to the surface of the recording medium and then to control the drying conditions by the control means.

Thus, the image forming apparatus 100 of this illustrative embodiment is provided with the moisture content ratio meter 46 and the density meter 48 at the downstream side of the drying device 26 with respect to the sheet conveying direction.

The moisture content ratio of the printing surface is measured by the moisture content ratio meter 36, so that the degree of the dryness of the printing surface is perceived. The moisture content ratio of the printing surface is changed depending On the type of the ink, the type of the continuous business form sheet P, the thickness of the continuous business form sheet P, the environmental conditions (the temperature and humidity of the exterior air, the temperature and humidity in the image forming apparatus 100), the printing speed (sheet speed), the non-uniformity in the discharge amount and the like of the droplet discharge head 22 and the non-uniformity in the temperature of the ink. As the moisture content ratio meter 46, the same meter as the moisture content ratio meter 44 may be used.

Also, an optical density (hereinafter, also referred to as 'OD value') of the printing surface is measured by the density meter 48, so that the amount of the color material close to the surface of the printing surface of the continuous business form sheet P is perceived. The OD value is also changed depending on the same factors as the non-uniformity in the moisture content ratio. The density meter 48 is not particularly limited and a general density meter is used. In this illustrative embodiment, a reflection-type density meter is used.

Like this, in the image forming apparatus 100 of this illustrative embodiment, after the sheet passes through the drying device 26, the degree of the dryness and the amount of the color material are perceived.

Figure 12A:
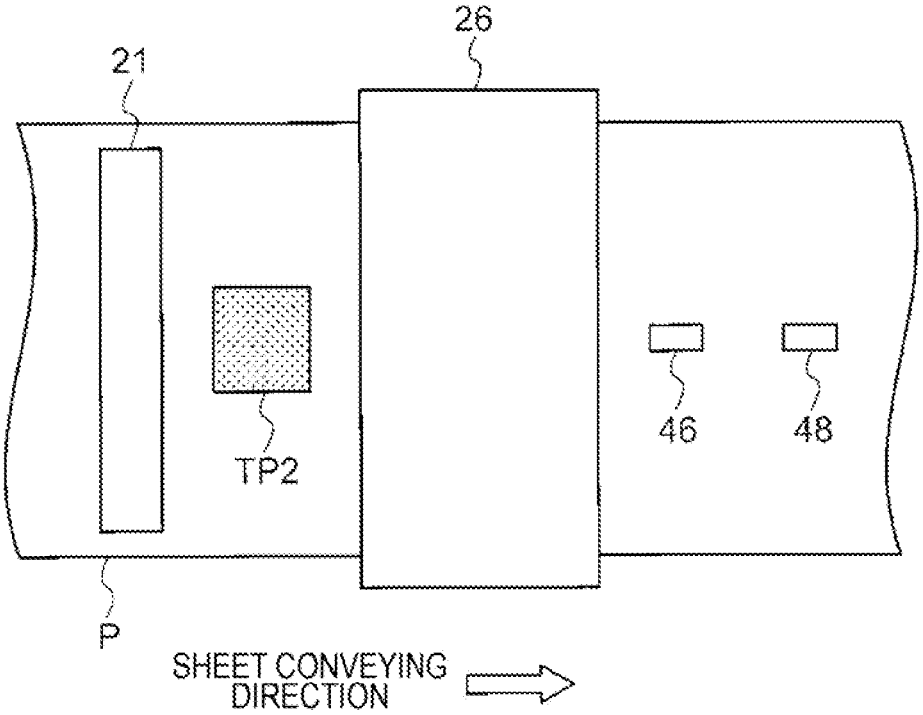
FIGS. 12A and 12B are plan views illustrating an arrangement relation among a printed state on a continuous business form sheet, a moisture content ratio meter and a density meter according to the second illustrative embodiment.
Figure 12B:
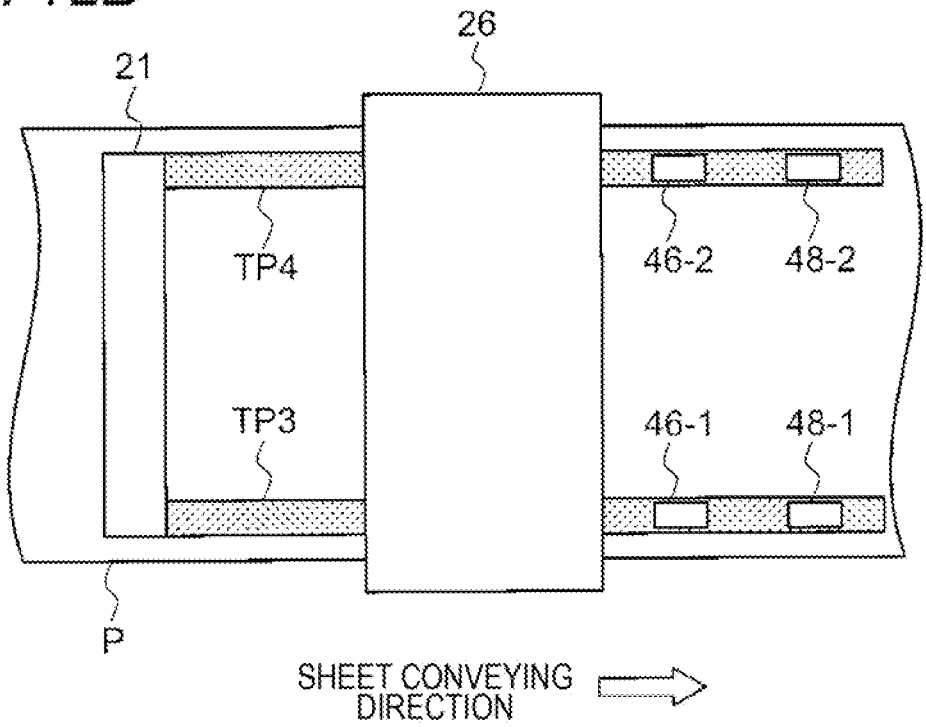

Like the image forming apparatus 10, also in the image forming apparatus 100, the test print part is used when measuring the moisture content ratio by the moisture content ratio meter 46 and measuring the OD value by the density meter 48. FIGS. 12A and 12B illustrate an arrangement relation among the test print part formed on the continuous business form sheet P, the moisture content ratio meter 46 and the density meter 48.

As shown in FIG. 12A, the moisture content ratio meter 46 and the density meter 48 are provided at a downstream side of the drying device 26 with respect to the sheet conveying direction. Also, the continuous business form sheet P is printed thereon with a test print part TP2 by the droplet discharge device 21. A moisture content ratio of the test print part TP2 is measured by the moisture content ratio meter 46 and an OD value of the test print part TP2 is measured by the density meter 48.

The test print part TP2 is followed by an image region Pg (not shown) of an image to be printed in the job, like FIG. 3. The test print part TP2 may be primed in correspondence to a density and a size (i.e., the maximum droplet election ratio and the size oldie maximum extraction region as described above) of a high density part of the image region Pg. Also, when measuring the moisture content ratio and OD value of the test print part TP2, a delay time from timing of the printing to timing of the measurement may be calculated in advance so that the front and rear blank parts are not mistaken as the test print part TP2, considering the timing of the printing by the droplet discharge device 21 and the sheet speed.

FIG. 12B illustrates test print parts TP3, TP4, which are other shapes of the test print part. The test print parts TP3, TP4 are formed at an outer side of the printable region of the continuous business form sheet P. Also, as the density meter and the density meter, moisture content ratio meters 46-1, 46-2 and density meters 48-1, 48-2 are provided two by two in correspondence to the test print parts TP3, TP4. In the example where the test print parts TP3, TP4 are used, it is not necessary to discriminate the print part and the front and rear blank parts of the print part, unlike the test print part TP2. Therefore, it is not necessary to consider the delay time, so that it is possible to simply perform the measurements by the moisture content ratio meters and the density meters.

In the below, a method of determining the drying conditions in the image forming apparatus 100 of this illustrative embodiment is described. First, a method of calculating the moisture content ratio and OD value (hereinafter, also referred to as 'target value', respectively) to be targeted in the determining method is described with reference to FIGS. 13A and 13B.

Figure 13A:
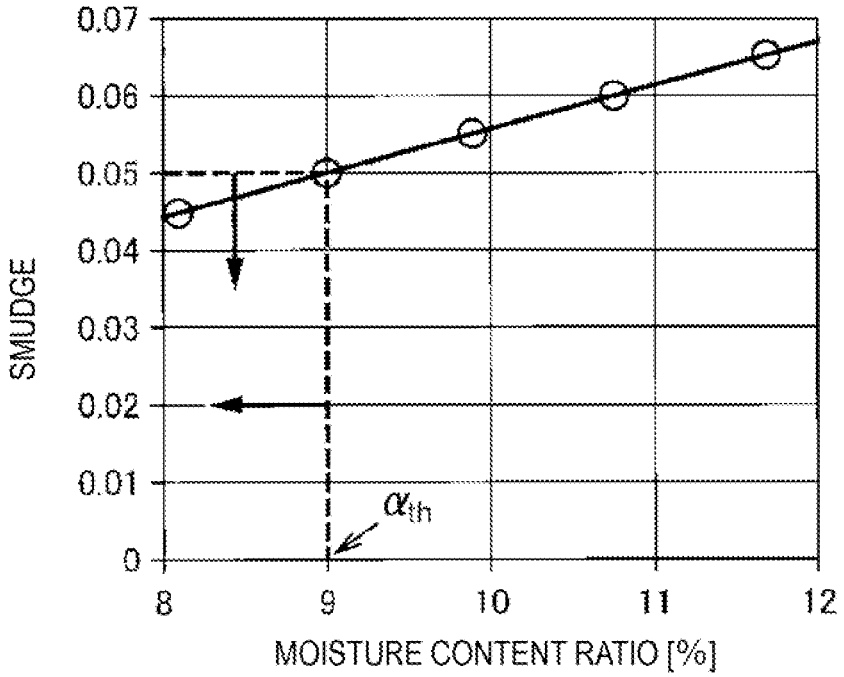
FIGS. 13A and 13B are graphs showing as relation between as moisture content ratio and smudge and a relation between an OD and the smudge according to the second illustrative embodiment.
Figure 13B:
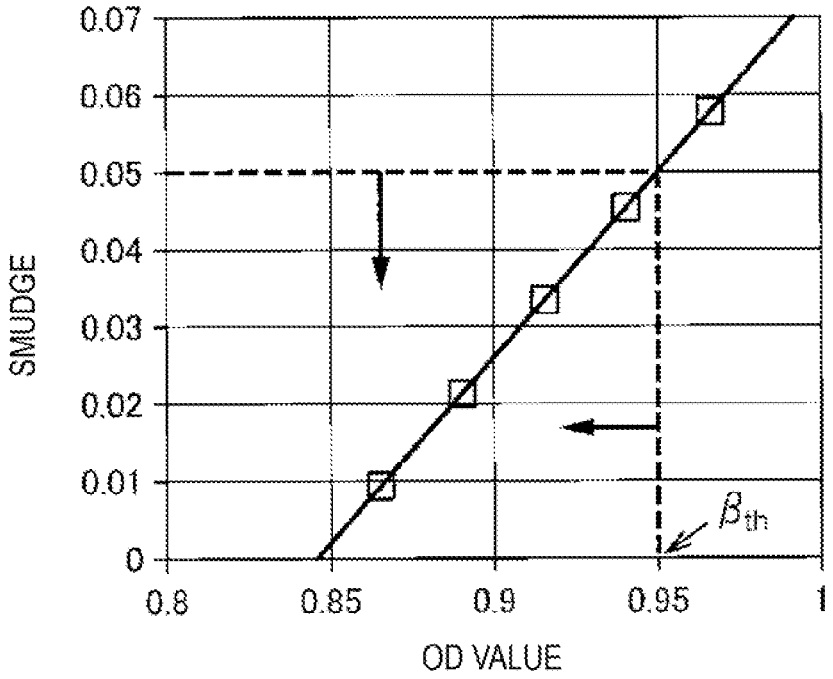

FIG. 13A is a graph showing a relation between the moisture content ratio and the smudge and FIG. 13B is a graph showing a relation between the OD value and the smudge. Both graphs are prepared by measuring the corresponding parameters after ejecting the inks with the predetermined droplet ejection ratio. In this illustrative embodiment, the 'smudge' is a characteristic used in substitution for the transfer of the image and the stained degree of the roller. That is, the smudge is expressed by an OD value of the ink transferred to a separate recording sheet by drying a printed recording sheet in the drying device 26, and then pressing and rubbing the separate recording sheet on the printed part. The smaller the smudge, it means that the transfer of the image and the stain of the roller are difficult to occur.

In the image forming apparatus 100 of this illustrative embodiment, a permitted value of the smudge is set to 0.05 or less. The permitted value is a value that is set by measuring and evaluating various smudges with an actual equipment of the image forming apparatus 100.

When the permitted value of the smudge is set to 0.05. the target value of the moisture content ratio is calculated as 9% (hereinafter, the target value of the moisture content ratio is denoted as '$\alpha_{th}$') from FIG. 13A, and the target value of the OD value is calculated as 0.95 (hereinafter, the target value of the OD value is denoted as '$\beta_{th}$') from FIG. 13B. That is, it can be seen that it is necessary to control the moisture content ratio to 9% or less and the OD value to 0.95 or less so as to suppress the smudge to 0.05 or less.

In the meantime, the relations shown in FIGS. 13A and 13B may be prepared in plural and distinguishingly used depending on the respective conditions of the type of the ink, the type of the continuous business form sheet P, the thickness of the continuous business form sheet P and the sheet speed. Also, the permitted value of the smudge is not limited to 0.05 and may be appropriately set depending on the permitted degree of the stain and the like.

Figure 14:
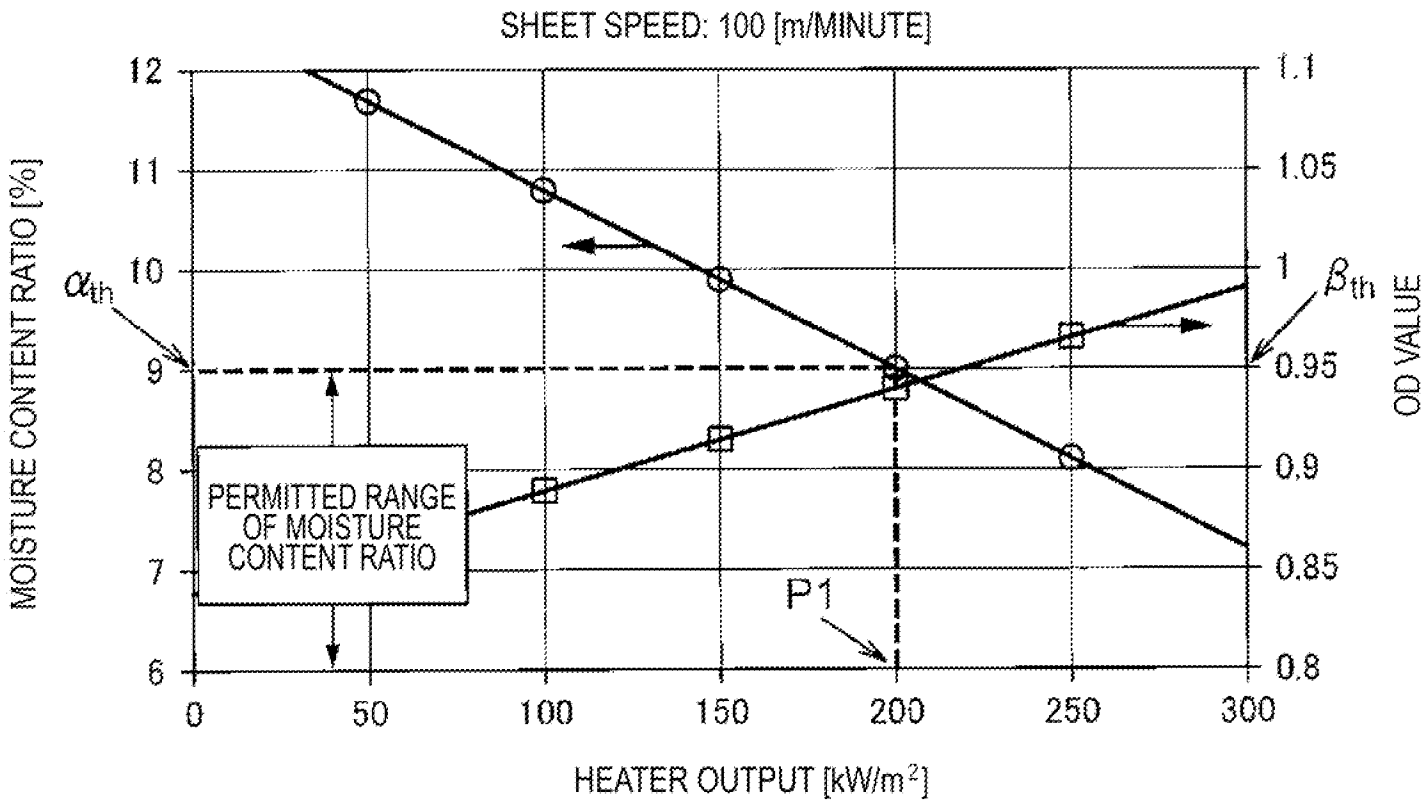
FIG. 14 is a graph showing a relation between a heater output and the moisture content ratio and a relation between the heater output and the OD according to the second illustrative embodiment.

FIG. 14 is a graph showing a relation between the heater output (kW/m$^2$) and the moisture content ratio (%) and a relation between the heater output (kW/m$^2$) and the OD value when the sheet speed is set to 100 m/minute. As shown in FIG. 14, the moisture content ratio shows a characteristic that it decreases rightwards with respect to the heater output, i.e., a characteristic that the moisture content ratio decreases as the heater output increases. On the other hand, the OD value shows a characteristic that it increases rightwards with respect to the heater output, i.e., a characteristic that the OD value increases as the heater output increases. FIG. 14 also shows the target value $\alpha_{th}$ (=9%) of the moisture content ratio and the target value $\beta_{th}$ (=0.95) of the OD value. In this illustrative embodiment, the heater output is determined from the measured moisture content ratio and OD value, based on FIG. 14.

Figure 15:
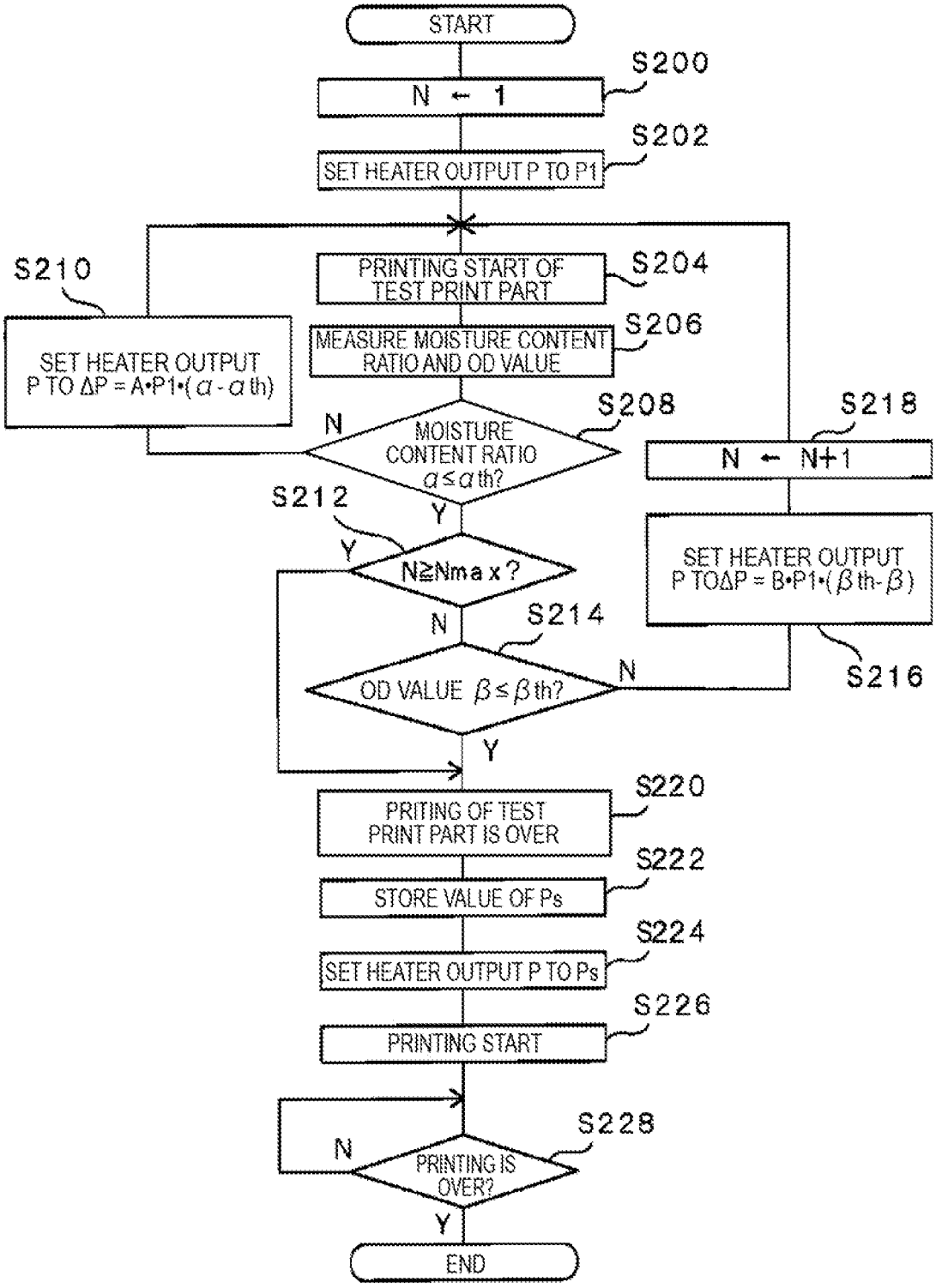
FIG. 15 is a flowchart showing a flow of processing of a drying condition determining processing program according to the second illustrative embodiment.

Subsequently, a drying condition determining processing that is executed in the image forming apparatus 100 of this illustrative embodiment is described with reference to FIG. 15. FIG. 15 is a flowchart showing a flow of processing of a drying control determining processing program that is executed by the CPU 32A of the image forming apparatus 100 of this illustrative embodiment.

The drying condition determining processing is processing for determining a heater output with which both the moisture content ratio and the OD value are within the target values. Meanwhile, in this illustrative embodiment, when it is difficult to bring both the moisture content ratio and the OD value within the target values, the heater output is determined with preference being given to the moisture content ratio. This is to avoid a case where when the moisture content ratio is high, a wrinkle occurs, as described above, and the wrinkle may contact and rub the tip of the droplet discharge head 22 depending on a degree of the wrinkle.

Also, the drying condition determining processing is executed continuously to the drying control processing described above. However, in the below, the descriptions of the drying control processing are omitted. Also, when the drying conditions are different between the drying condition determining processing and the drying control processing, a result of the drying control processing may be corrected (for example, the heater output determined by the drying control processing may be multiplied by a predetermined coefficient) by a result of the drying condition determining processing. Alternatively, the priority may be given to any one of the results of the drying condition determining processing and the drying control processing.

After the image information of an image to be printed is supplied from an external apparatus (not shown) and the like to the image forming apparatus 100, when an instruction to start the printing is issued, the CPU 32A reads out a drying condition determining processing program from the storage means such as the ROM 32B and the like, so that the processing shown in FIG. 15 is executed.

In the drying condition determining processing of this illustrative embodiment, the test print part TP2 (or the test print parts TP3, TP4) may be arranged at a head of the job and the drying conditions may be determined for each job. Alternatively, the test print part TP2 (or the test print parts TP3, TP4) may be arranged periodically in the job to periodically control the drying conditions during the job. In FIG. 15, an example where the test print part TP2 is arranged at the head of the job is described. Meanwhile, the method of determining the droplet ejection ratio and size of the test print part TP2 is the same as FIGS. 5A and 5B. In below descriptions, it is regarded that the determination of the droplet ejection ratio and size of the test print part TP2 is being already made. That is, in this illustrative embodiment, the test print part TP1 selected in the drying control processing is used as the test print part TP2.

As shown in FIG. 15, the CPU 32A assigns 1 to a counter N to initialize the same in step S200. The counter N is a counter for counting a number of repeating times when calculating a net change ΔP of the heater output P on the basis of the OD value β and repeating the measurements of the moisture content ratio α and OD value β of the test print part TP2.

In next step S202, the CPU 32A sets the heater output P to art initial value P1. As shown in FIG. 14, the initial value P1 is the heater output P (about 200 kW/m$^2$, in this illustrative embodiment, as shown in FIG. 14) when the moisture content ratio α becomes the target value $\alpha_{th}$. The initial value P1 may be preset by a test using an actual equipment of the image forming apparatus 100, and the like, and may be stored in the storage means such as the ROM 32B.

In next step S204, the CPU 32A starts to print the test print part TP2.

In next step S206, the CPU 32A measures the moisture content ratio α by the moisture content ratio meter 46 and the OD value β by the density meter 48.

In next step S208, the CPU 32A determines whether the moisture content ratio α is less than the target value $\alpha_{th}$. When a result of the determination is positive, the CPU 32A proceeds to step S212. On the other hand, when a result of the determination is negative, the CPU 32A proceeds to step S210 and calculates the net change ΔP of the heater output P by at following equation (2). Thereafter, the CPU 32A proceeds to step S204 and again prints the test print part TP2 and measures the moisture content ratio α and the OD value β.

$$\Delta P = A \cdot P1 \cdot (\alpha - \alpha_{th}) \quad (2)$$

Here, α indicates the moisture content ratio measured in step S206 and A indicates a predetermined positive constant.

In step S212, the CPU 32A determines whether the value of the counter N is Nmax or greater. When a result of the determination is positive, the CPU 32A proceeds to step S220. On the other hand, when a result of the determination is negative, the CPU 32A proceeds to step S214. Nmax is an upper limit of the counter N and is a positive constant.

The upper limit Nmax is an upper limit for avoiding a situation where a loop shown in steps S214 to S218 becomes an endless loop. The situation where an endless loop is made means a situation where after the heater output is set by the moisture content ratio $\alpha$, it is difficult to bring the OD value $\beta$ within the target value $\beta_{th}$. In this case, the heater output is determined with preference being given to the moisture con tent ratio $\alpha$, as described above. In the meantime, the value of the upper limit Nmax may be appropriately set, considering the calculation time and the like. In this illustrative embodiment, the upper limit Nmax is set to 5. Also, the upper limit Nmax may be stored in the storage means such as the ROM 32B.

In step S214, the CPU 32A determines whether the OD value $\beta$ is less than the target value $\beta_{th}$. When a result of the determination is positive, the CPU 32A proceeds to step S220. On the other hand, when a result of the determination is negative, the CPU 32A proceeds to step S216.

In step S216, the CPU 32A calculates the net change $\Delta P$ of the heater output P by a following equation (3).

$$\Delta P = B \cdot P1 \cdot (\beta_{th} - \beta) \quad (3)$$

Here, $\beta$ indicates the OD value measured in step S206 and B is a predetermined positive constant.

In next step S218, the CPU 32A increments the value of the counter N by 1 and then proceeds to step S204, and again prints the test print part TP2 and measures the moisture content ratio $\alpha$ and the OD value $\beta$.

In next step S220, the CPU 32A ends the printing operation of the test print part TP2.

In next step S222, the CPU 32A stores a heater output Ps, which is obtained by adding the initial value P1 to the net change $\Delta P$ of the heater output P at that time, in the storage means such as the RAM 32C, the NVM 32D and the like.

In next step S224, the CPU 32A sets the heater output Ps stored in step S222, as the heater output P of the heater 50.

In next step S226, the CPU 32A starts to print the job.

In next step S228, the CPU 32A determines whether the printing is over. When a result of the determination is negative, the CPU 32A continues the printing, and when a result of the determination is positive, the CPU 32A ends the drying condition determining processing program. The CPU 32A may determine whether the printing is over by determining whether the printing of a number of sheets to be pouted set by a user before the pruning is completed.

Subsequently, a relation between the heater output P and the sheet speed is described with reference to FIGS. 16A and 16B.

Figure 16A:
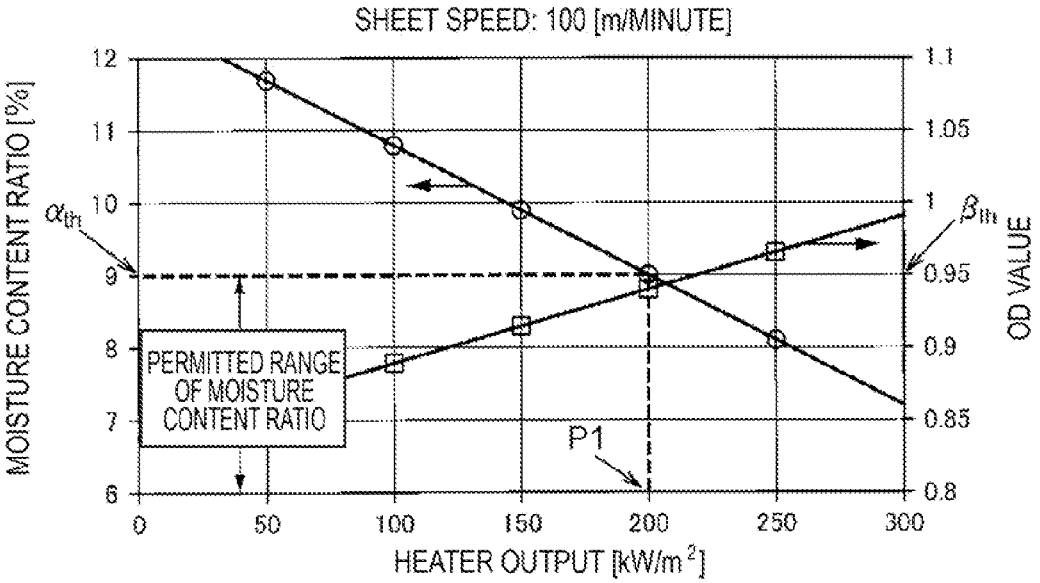
FIGS. 16A and 16B are graphs showing a relation between the heater output and the moisture content ratio and a relation between the heater output and the OD, in which the sheet speed is used as a parameter, according to the second illustrative embodiment.
Figure 16B:
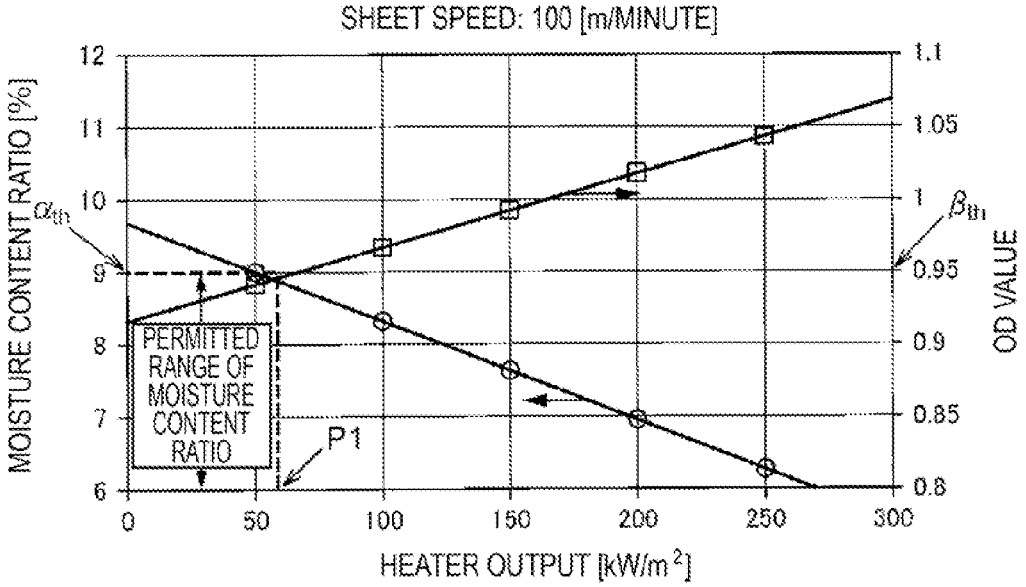

FIG. 16A is the same as FIG. 14, and FIG. 16B is a graph showing a relation between the heater output (kW/m$^2$) and the moisture content ratio (%) and a relation between the heater output (kW/m$^2$) and the OD value when the sheet speed is set to 10 m/minute.

As clearly seen from FIG. 16A and 16B, the sheet speed is closely related to the drying capability of the drying device 26. That is, when the sheet speed is slowed down, the heater output P can be lowered. Specifically, when the sheet speed is 100 m/minute, the heater output P1 is about 200 kW/m$^2$. In contrast, when the sheet speed is 10 m/minute, the heater output P1 can be lowered to about 60 kW/m$^2$. Like this, the sheet speed can be used as one parameter when determining the drying conditions. However, considering that the sheet speed influences the productivity of the printing (when the sheet speed is slowed down, the productivity of the printing is also lowered), the drying conditions may be determined by slowing down the sheet speed only when the heater output P is deficient in capability.

In this illustrative embodiment, the configuration where the moisture content ratio meter 44, the moisture content ratio meter 46 and the density meter 48 are provided has been described. However, the present invention is not limited thereto. For example, a configuration where the moisture content ratio meter 46 and the density meter 48 are provided, i.e., a configuration of executing only the drying condition determining processing is also possible.

As described in detail above, according to the drying device, the image forming apparatus and the program of this illustrative embodiment, the sheet deformation due to the excessive drying energy is suppressed. According to the drying device, the image forming apparatus and the program of this illustrative embodiment, the transfer of the image and the stain of the roller due to the deficiency in the drying energy are also suppressed.

In the respective illustrative embodiments, the present invention is applied to the image forming apparatus of the inkjet type. However, the present invention is not limited thereto. For example, the present invention can also be applied to an image forming apparatus of an electrophotographic type.

In the respective illustrative embodiments, the continuous business form sheet P has been exemplified as the recording medium. However, the present invention is not limited thereto. For example, a cut sheet can also be adopted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drying device comprising:

a drying unit configured to dry a recording medium having an image formed thereon by an image forming unit;

a detection unit configured to detect a moisture content ratio of a print part having predetermined density and size and formed on the recording medium and a moisture content ratio of a blank part, which is a region of the recording medium on which an image is not formed, before the recording medium having the image formed thereon is conveyed to the drying unit by a conveyance unit, the detection unit being downstream from the image forming unit and upstream of the drying unit in a conveyance direction of the conveyance unit; and a control unit configured to control at least one of a drying strength of the drying unit and a conveying speed of the conveyance unit on the basis of the moisture content ratio of the print part and the moisture content ratio of the blank part.

2. The drying device according to claim 1, wherein the control unit is configured to control at least one of the drying strength of the drying unit and the conveying speed of the conveyance unit on the basis of a moisture content ratio difference between the moisture content ratio of the print part and the moisture content ratio of the blank part.

3. The drying device according to claim 2, wherein the control unit is configured to lower the drying strength of the drying unit and to lower the conveying speed of the conveyance unit as the moisture content ratio difference is larger, when controlling at least one of the drying strength of the drying unit and the conveying speed of the conveyance unit.

4. The drying device according to claim 1, wherein a relation among a magnitude of the moisture content ratio, the drying strength and the conveying speed is predetermined on the basis of a deformation amount of the recording medium having the image formed thereon due to heat of the drying unit.

5. The drying device according to claim 1, wherein a relation among a magnitude of the moisture content ratio, the drying strength and the conveying speed is predetermined depending on at least one of a type of a formation medium when forming an image on the recording medium in the image forming unit, a type of the recording medium and a thickness of the recording medium.

6. The drying device according to claim 1, further comprising a determination unit configured to determine a density of the print part on the basis of the highest density in image information of an image to be formed by the image forming unit and to determine a size of the print part on the basis of an area of a region having the highest density in the image information or a region having a density or greater, which is lower than the highest density by a predetermined density.

7. The drying device according to claim 1, wherein the print part is formed in a region except for a region predetermined as an image forming region of the recording medium.

8. The drying device according to claim 1, further comprising a detection unit configured to detect at least one of the moisture content ratio and density of the print part formed on the recording medium after the recording medium passes through the drying unit, wherein the control unit is configured to further control at least one of the drying strength of the drying unit and the conveying speed of the conveyance unit on the basis of the moisture content ratio detected by the detection unit and at least one of the moisture content ratio and density detected by the detection unit.

9. An image forming apparatus comprising:

an image forming unit configured to form an image on a recording medium, and the drying device according to claim 1, the drying device being disposed at a downstream side in a conveying direction of the recording medium with respect to the image forming unit.

10. A non-transitory computer readable medium storing a program for controlling a drying device which comprises:

a drying unit configured to dry a recording medium having an image formed thereon by an image forming unit; and a detection unit configured to detect a moisture content ratio of a print part having predetermined density and size and formed on the recording medium and a moisture content ratio of a blank part, which is a region of the recording medium on which an image is not formed, before the recording medium having the image formed thereon is conveyed to the drying unit by a conveyance unit, the detection unit being downstream from the image forming unit and upstream of the drying unit in a conveyance direction of the conveyance unit, the program causing a computer to function as a control unit configured to control at least one of a drying strength of the drying unit and a conveying speed of the conveyance unit on the basis of the moisture content ratio of the print part and the moisture content ratio of the blank part.

* * * * *